US007159870B2

(12) United States Patent
Kim

(10) Patent No.: US 7,159,870 B2
(45) Date of Patent: Jan. 9, 2007

(54) SEALING AT THE JUNCTURE OF THREE MEMBERS

(75) Inventor: Tae-Kyung Kim, Sterling Heights, MI (US)

(73) Assignee: Eaton Corporation, Cleveland, OH (US)

( * ) Notice: Subject to any disclaimer, the term of this patent is extended or adjusted under 35 U.S.C. 154(b) by 100 days.

(21) Appl. No.: 10/673,809

(22) Filed: Sep. 29, 2003

(65) Prior Publication Data

US 2005/0067786 A1 Mar. 31, 2005

(51) Int. Cl.
*F02F 11/00* (2006.01)

(52) U.S. Cl. ..... 277/313; 277/591; 277/598

(58) Field of Classification Search ..... 277/591–597, 277/628, 598, 313
See application file for complete search history.

(56) References Cited

U.S. PATENT DOCUMENTS

| | | | | |
|---|---|---|---|---|
| 3,330,567 | A * | 7/1967 | Mercer et al. | 277/589 |
| 3,896,722 | A * | 7/1975 | Farrow | 101/115 |
| 4,535,996 | A * | 8/1985 | Cardis et al. | 277/313 |
| 5,275,420 | A * | 1/1994 | Rodenkirch | 277/313 |
| 6,056,296 | A * | 5/2000 | Ii | 277/595 |
| 6,471,095 | B1 * | 10/2002 | Cann | 222/190 |
| 6,575,471 | B1 * | 6/2003 | Grosspietsch et al. | 277/436 |
| 6,659,471 | B1 * | 12/2003 | Mori et al. | 277/592 |
| 6,712,365 | B1 * | 3/2004 | Barinaga et al. | 277/628 |
| RE38,814 | E * | 10/2005 | Wright | 600/37 |

* cited by examiner

*Primary Examiner*—Vishal Patel
(74) *Attorney, Agent, or Firm*—Anna M. Shih; Roger A. Johnston

(57) ABSTRACT

A three-prong integrally formed resilient seal for sealing the juncture of three gasketed members. The seal has a common region having an embedded strain distributor of stiffer material than the remainder of the seal which is integrally formed, preferably by insert molding as a one-piece member.

8 Claims, 2 Drawing Sheets

SEALING AT THE JUNCTURE OF THREE MEMBERS

BACKGROUND OF THE INVENTION

The present invention relates to providing sealing at the juncture of three gasketed members and particularly relates to motor vehicle engines of the type having banks of cylinders arranged in a V-configuration and having provision for deactivation of the combustion chamber valves during engine operation.

Engines with valve deactivation may employ a plurality of solenoid operated valves to control the flow of hydraulic fluid or engine lubricant to the valve lifters or lash adjusters in a manner to prevent the engine cam from moving the combustion chamber valves for individual cylinders thereby disabling charge flow to the cylinder and preventing combustion in the cylinder.

Heretofore, for multi-cylinder engines having a V-arrangement of the cylinder banks it has been found satisfactory to provide the control valves for valve deactivation on a common manifold which may then be easily attached to the top of the engine cylinder block in the valley or area between the cylinder banks in a V-type engine. However, such an arrangement requires interfacial sealing of the valve manifold assembly with not only the top of the engine block but also the edges of the adjacent cylinder heads in order to provide proper communication of the control valves with the oil galleries to the valve lifters or lash adjusters for each of the engine valves. In such an arrangement problems have been encountered in sealing at the juncture of the gaskets for the engine block, valve deactivation manifold and the cylinder head.

This problem is particularly difficult in view of the abutment of the gaskets between (i) the valve deactivation manifold and the cylinder block, (ii) between the deactivation manifold cylinder head and (iii) between the cylinder head and the cylinder block.

Accordingly, it has been desired to provide a simplified, low-cost way of sealing at the juncture of three components or members and particularly between the valve deactivation manifold, cylinder head and cylinder block for an internal combustion engine.

BRIEF SUMMARY OF THE INVENTION

The present invention provides a solution to the above-described problem of providing sealing at the juncture of three members having sealing gaskets between adjacent members in a manner which is reliable, robust in service, as for example in an internal combustion engine, and is easy to install during assembly of the engine.

The present invention provides resilient elastomeric one-piece seal member having three portions extending from a common region in discrete directions with a strain distributor embedded in the common region and which is formed of material significantly stiffer than the elastomeric material seal.

In the presently preferred practice the elastomeric seal has a hardness not greater than 75 on the Shore "A" scale and the strain distributor has a hardness of at least about 10 greater on the Shore "A" scale. The strain distributor may be formed of one of elastomeric, metallic and plastic material.

DETAILED DESCRIPTION OF THE INVENTION

Figure 1:
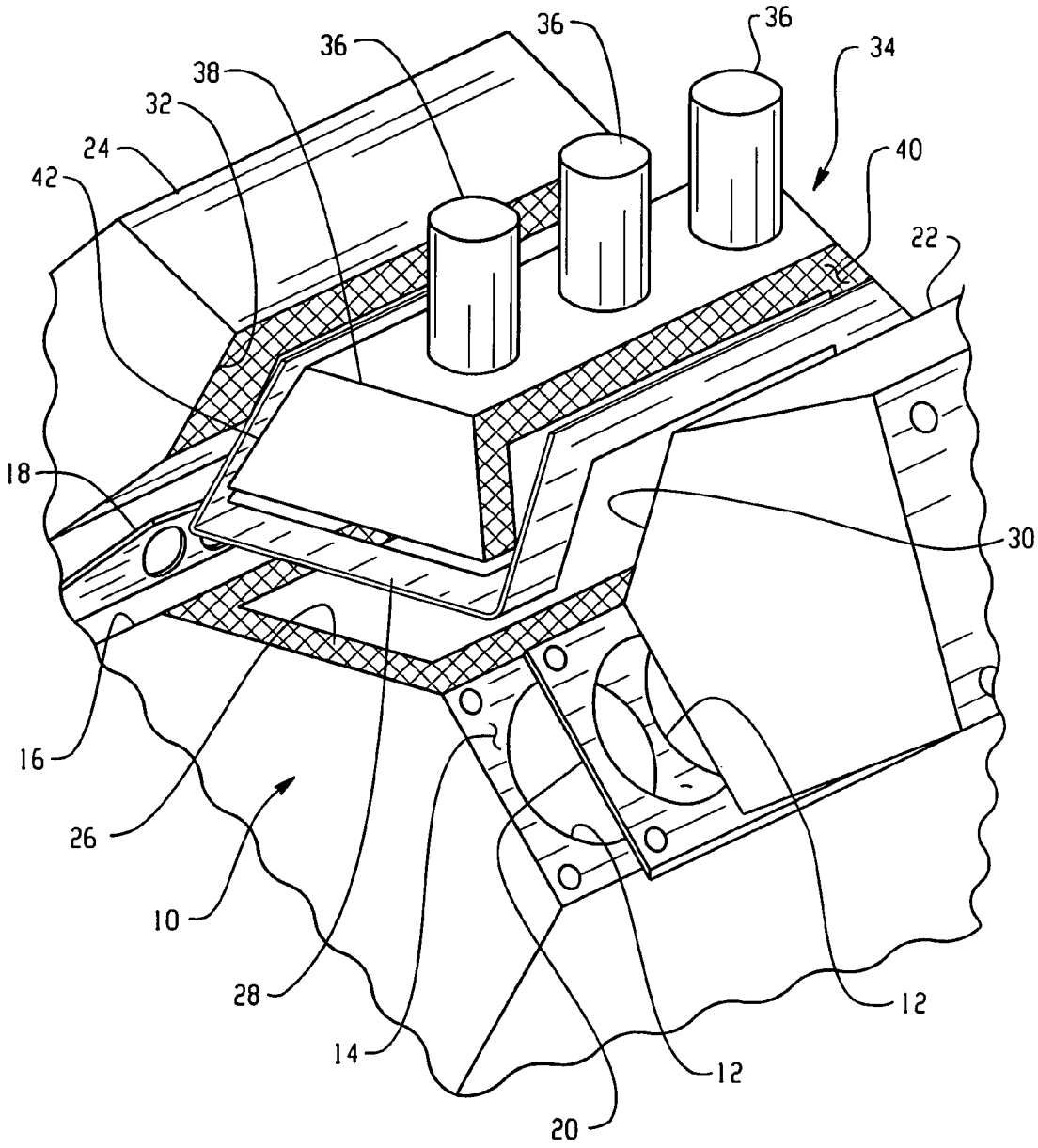
FIG. 1 is an exploded view of an engine cylinder block, cylinder head and valve deactivation manifold assembly; and, FIG. 2 is an enlarged exploded view of a portion of FIG. 1.

Referring to FIG. 1, an engine block 10 has the cylinders 12 arranged in banks forming a central V or valley with the cylinder banks each having a top surface respectively 14, 16 over which is seated a head gasket respectively 18, 20 and cylinder head respectively 22, 24. The central region of the cylinder block 10 between the banks of cylinders has a horizontal rim denoted by reference numeral 26 which surrounds the valley of the cylinder block and provides a sealing surface as will hereinafter be described. A single-gasket 28 is disposed over the rim 26 and is folded upwardly about its margins to seal the edge surface of each cylinder head denoted respectively 30, 32.

A valve de-actuator manifold assembly indicated generally at 34 includes a plurality of solenoid operated valves 36 mounted on a manifold block 38 which has the opposite sides thereof extending in the direction of the cylinder banks configured with a sealing surface 40, 42. The surfaces 40, 42 are sealed about the top surface of the gasket 28; whereas, the surfaces 26, 30, 32 are sealed about the undersurface of the gasket 28.

With reference to FIG. 1, the sealing surfaces 26, 32, 38, 40 are bi-directionally cross-hatched for visual emphasis.

Figure 2:
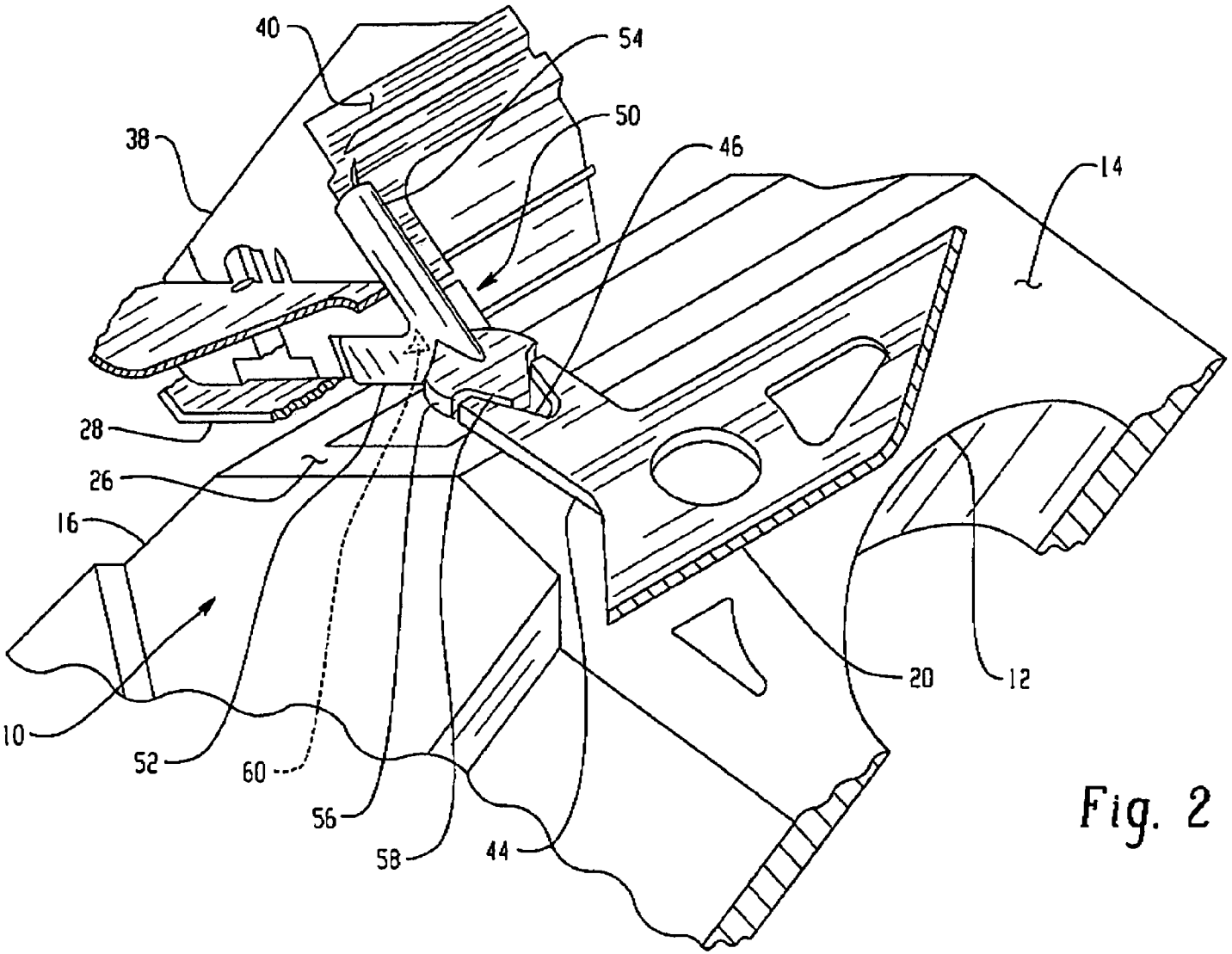

Referring to FIG. 2, cylinder head gasket 20 is formed with a projection 44 extending from a corner thereof which projection has, in the presently preferred practice, a notch or recess 46 formed therein at the end thereof. Projection 44 extends from the head gasket in a direction inwardly toward the valley of the engine block 10. It will be understood however that the head gasket may be configured with extra material such that a projection is not required; however, preferably the recess 46 is formed and the edge of the gasket in the region underlying the edge of the cylinder head.

The sealing technique of the present invention utilizes a three-prong seal having three discrete outwardly extending portions from a central common region as indicated generally at 50. Seal 50 has a first and second sealing portion 52, 54 extending outwardly therefrom in discrete directions with the portion 52 disposed to seal between the undersurface of manifold 38 and the rim 26 of the engine block; and, the portion 54 is disposed for sealing between surface 40 of the manifold and the side 30 of the cylinder head 22 (not shown in FIG. 2). The seal 50 has a third portion extending in a discrete direction away from portions 52, 54 and preferably having a flat or rectangular configuration with the longer dimension thereof disposed at right angles to the plane form by the portions 52, 54. The third portion 56 has a tab 58 formed thereon which is configured to interfit or interdigitate the recess 46 in the head gasket 44 and has a thickness slightly greater than the thickness of the head gasket 44 such that when the portion 56 is compressed between the cylinder head (not shown in FIG. 2) and the top of the cylinder surface 14 the portion 56 is compressed and deforms to seal in the recess 46 in addition to sealing between the engine block and the cylinder head.

The sealing insert 50 has a strain distributor disposed in the common or central region thereof between the portions

52, 54, 56; and, the strain distributor 60 is formed of material significantly harder or stiffer than the material of the insert 50.

In the presently preferred practice of the invention, the strain distributor 60 is formed of material having a durometer of about 10 greater on the Shore "A" scale than the material of the seal 50. In the presently preferred practice of the invention, the strain distributor is formed of one of elastomeric, metallic and plastic material. In the present practice the sealing member 50 is preferably formed of elastomeric material having a durometer not greater than about 75 on the Shore "A" scale; and, preferably the strain distributor 56 is embedded therein by insert molding. The portions 52, 54, 56 formed integrally as a one-piece member by molding. It will be understood that other materials and other hardnesses may be employed if desired.

The present invention thus provides a unique and novel technique for insuring the sealing between the juncture of three members; and, has particular application for sealing such a junction between a valve deactivating manifold, engine block and cylinder head for a multi-cylinder internal combustion engine having a V-configuration and capable of operating with selected ones of the engine combustion chamber valves disabled.

Although the invention has hereinabove been described with respect to the illustrated embodiments, it will be understood that the invention is capable of modification and variation and is limited only by the following claims.

What is claimed is:

1. A method of sealing at the juncture of a valve deactivation manifold, an engine block and an engine cylinder head sealed over the cylinders with a head gasket comprising:

providing a sealing surface on an edge of the cylinder head gasket;

forming a one-piece seal member of elastomeric material with three portions thereof each extending from a common region in a discrete direction; forming a strain distributor of material significantly more rigid than said elastomeric material and embedding said distributor in said elastomeric material in said common region; and, disposing said seal member at said juncture and contacting the sealing surface with one of said three portions of said seal member.

2. The method defined in claim 1, wherein said step of contacting includes interdigitating.

3. The method defined in claim 1, wherein said step of forming a strain distributor includes forming of material having a hardness of at least 10 on the Shore "A" scale greater than said elastomeric material.

4. The method defined in claim 1, wherein said step of forming a strain distributor includes forming of one of elastomeric, metallic and plastic material.

5. The method defined in claim 1, wherein said step of forming a one-piece seal member includes molding.

6. The method defined in claim 1, wherein said step of disposing a distributor includes insert molding.

7. The method defined in claim 1, wherein said step of forming a seal member includes forming a member having a durometer not greater than about 75 on the Shore "A" scale.

8. The method defined in claim 1, wherein said step of forming a seal member includes forming one of said three portions oriented at right angles to a plane formed by the other two of said three portions.

* * * * *